United States Patent [19]

Ostkamp et al.

[11] 4,451,247

[45] May 29, 1984

[54] CONTINUOUS, COMPLETELY JACKETED, COUNTERCURRENT CENTRIFUGAL EXTRACTOR

[75] Inventors: Willi Ostkamp; Karlheinz Brunner; Friedrich Wibbelt, all of Oelde, Fed. Rep. of Germany

[73] Assignee: Westfalia Separator AG, Oelde, Fed. Rep. of Germany

[21] Appl. No.: 459,014

[22] Filed: Jan. 18, 1983

[30] Foreign Application Priority Data

Jan. 26, 1982 [DE] Fed. Rep. of Germany ..... 3202294

[51] Int. Cl.[3] ..... B04B 1/20

[52] U.S. Cl. ..... 494/52

[58] Field of Search ..... 494/52, 53, 54, 27, 494/29, 56

[56] References Cited

U.S. PATENT DOCUMENTS

| | | | |
|---|---|---|---|
| 3,228,594 | 1/1966 | Amero | 494/53 |
| 3,501,346 | 3/1970 | Katzen | 494/53 |
| 3,782,623 | 1/1974 | Jorgen | 494/53 |
| 4,190,194 | 2/1980 | Amero | 494/53 |

*Primary Examiner*—Robert W. Jenkins

*Attorney, Agent, or Firm*—Sprung, Horn, Kramer & Woods

[57] ABSTRACT

A continuous, completely jacketed countercurrent centrifugal extractor of the type utilized to mix and separate two liquids that have different specific gravities and enter through separate inlets. The extractor has at least one overflow weir in a mixing zone between the inlet for the specifically lighter and the inlet for the specifically heavier liquid phase and a division of the mixing zone into mixing-and-separation compartments. Access channels empty into the vicinity of the inner surface of a drum jacket and into that of the heavier phase, to conduct the lighter phase out of the compartment inside the hub of a conveyor worm into the initial mixing-and-separation compartment. One or more overflow channels also empty into the vicinity of the heavier phase, in the overflow weir to divert the lighter phase separated in the initial mixing-and-separation compartment into another and subsequent mixing-and-separation compartment. The design creates several highly efficient contact points in the vicinity of the mixing zone that enhance the extracting action.

6 Claims, 2 Drawing Figures

CONTINUOUS, COMPLETELY JACKETED, COUNTERCURRENT CENTRIFUGAL EXTRACTOR

BACKGROUND OF THE INVENTION

The present invention relates to a continuous, completely jacketed countercurrent centrifugal extractor of the type utilized to mix and separate two liquids that have different specific gravities and enter through separate inlets, the extractor having an at least to some extent conical drum that can rotate under power around a horizontal axis and contains both clarified-liquid zones and a mixing zone, with liquids flowing into the mixing zone from compartments inside the drum. The extractor also has, inside the drum, a conveyer worm that can rotate under power at a speed different from that at which the drum jacket itself rotates, that has threads that conform to the inner surface of the jacket and conveys the solids that settle under centrifugal force in the separating space between the hub of the worm and the drum into a conically contracting end of the drum. Moreover, the extractor has both a skimmer inside a skimming compartment for carrying off an initial liquid phase and, for another liquid phase, a discharge space that is separated from the separation space by an overflow weir and sealed off from the skimming compartment.

Centrifugal extractors of this type are utilized to transfer an extract that has been dissolved in a liquid, which preferably contains a high oncentration of solids, into a liquid extractant. The extract must be more soluble in the extractant than in the liquid. The extractant can represent either the specifically light or the specifically heavy liquid phase. To obtain a high extraction yield, transferring the extract from an aqueous liquid phase that contains solids into an extractant presupposes adequate intermixture of or intimate contact between the two liquid phases. The number of attainable extraction stages, and hence the yield of extract, is especially high when the process can be carried out in a countercurrent in the mixing zone. Countercurrent extraction can also be conducted with a minimum of extractant.

In known centrifugal extractors, the two liquid phases are introduced through separate lines into separate compartments inside the hub of the conveyer worm and then through openings into a mixing zone in the vicinity of the threads. The liquid are simultaneously forced in a countercurrent with a powerful mixing action through the threads.

It has been demonstrated that intimate contact, and hence a satisfactory mixing action, will occur inside the mixing zone only when the densities of the two liquid phases are not too different, so that they will readily tend to emulsify.

Promoting intermixture by mounting a number of contact points, such as segments or shaped parts, inside the threads in the vicinity of the mixing zone is, of course known from German Pat. No. 2,701,763. Such components will, however, augment the mixing action only to a very limited extent, as thorough going tests have demonstrated, because the mixture of liquids inside the threads will separate again very rapidly as the result of centrifugal forces.

Tests have also demonstrated that the most thorough mixing action can be attained when the fluid leaving the compartment inside the hub and entering the mixing zone is always introduced directly into the other liquid phase, as occurs when the specifically heavier phase enters the mixing zone, where its higher specific gravity can force it through the specifically lighter phase into the outer region of the drum. These conditions promote intimate contact between the two phases. When the lighter phase flows into the mixing zone on the other hand, it will essentially come into contact only with the surface of the heavier phase, resulting in a weaker action.

SUMMARY OF THE INVENTION

The objective of the present invention is to provide a completely jacketed countercurrent centrifugal extractor of the type described, with an extracting action that is enhanced by several highly efficient contact points in the vicinity of its mixing zone.

This objective is attained in accordance with the present invention by at least one overflow weir in the mixing zone between the inlet for the specifically lighter and that for the specifically heavier liquid phase, by a division of the mixing zone into mixing-and-separation compartments, by access channels, emptying into the vicinity of the inner surface of the drum jacket and into that of the heavier phase, to conduct the lighter phase out of the compartment inside the hub of the conveyer worm into the initial mixing-and-separation compartment, and by one or more overflow channels, also emptying into the vicinity of the heavier phase, in the overflow weir to divert the lighter phase separated in the initial mixing-and-separation compartment into another and subsequent mixing-and-separation compartment.

An access channel, extending into the vicinity of the inner surface and hence into that of the heavier phase, to conduct the lighter phase plus an overflow weir in the mixing zone with an overflow channel, also extending into the vicinity of the heavier phase, for the lighter phase that is separated in the initial mixing-and-separating compartment, create two additional intimate mixture contact points in the extractor that considerably augment its extracting action.

One embodiment of the invention will now be specified with reference to the drawings, wherein:

DETAILED DESCRIPTION OF THE INVENTION

Figure 1:
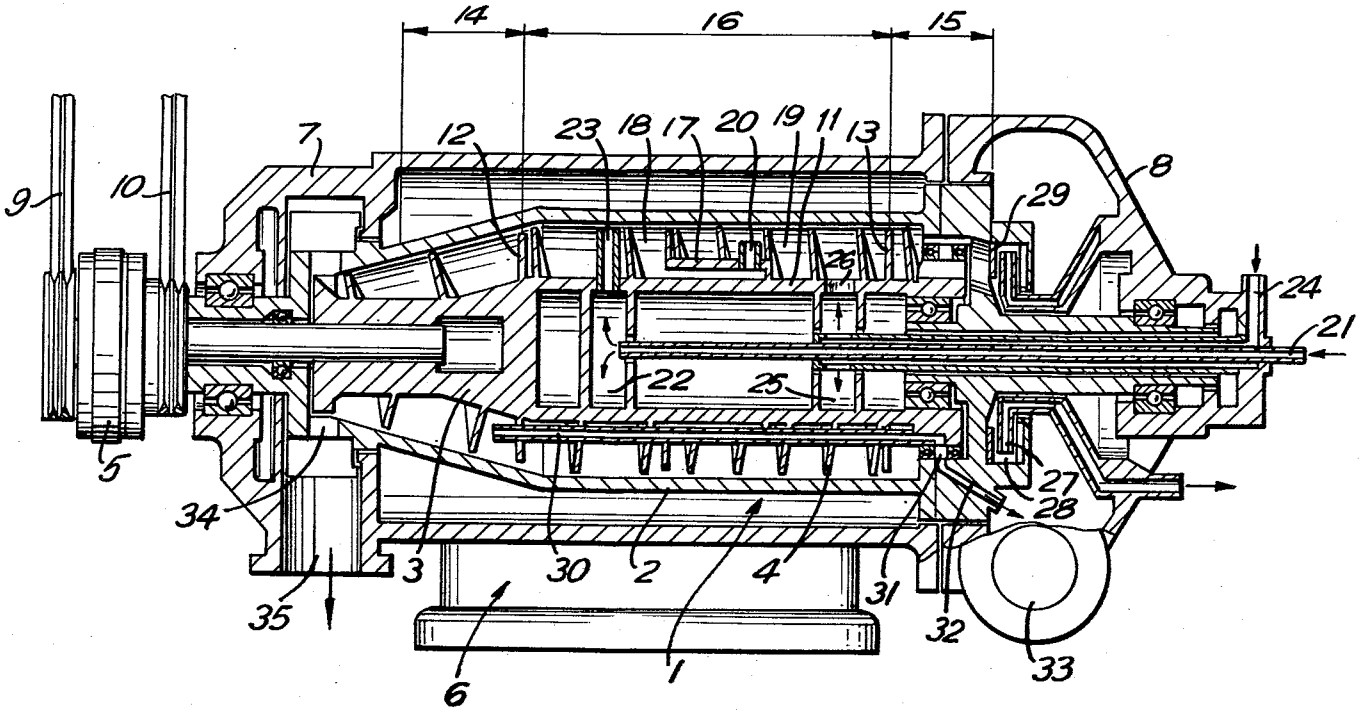
FIG. 1 is a schematic vertical and longitudinal section through a completely jacketed countercurrent centrifugal extractor according to the invention and FIG. 2 is a partial section through the extractor in FIG. 1 illustrating the mixing zone on a larger scale.

FIG. 1 illustrates a completely jacketed countercurrent centrifugal extractor that consists of a cylindrical-conical drum 1. Drum 1 contains a conveyer worm 3 that can rotate under power at a speed different from that at which the drum jacket 2 itself rotates. Worm 3 has threads 4 that conform to the inner surface of jacket 2. The speeds at which jacket 2 and worm 3 rotate are separately controlled by a cyclodrive mechanism 5 connected to them. Drum 1 is mounted to rotate in a housing 6 consisting of a case 7 and cover 8. Power can be supplied to jacket 2 and worm 3 through mechanism 5 by an electric motor for example, not illustrated, that turns the mechanism and hence the jacket and worm at a selected speed through V-belts 9 and 10.

There are separating disks 12 and 13 in the vicinity of threads 4 between the hub 11 of worm 3 and the jacket 2 of drum 1. Disks 12 and 13 divide the separating space into clarified-liquid zones 14 and 15 and a mixing zone 16.

Inside mixing zone 16 is an overflow weir 17 that has an annular gap facing the inner surface of jacket 2, that is sealed off from hub 11, that is angular in shape, and that divides the mixing zone into an initial 18 and a subsequent 19 mixing-and-separation compartment. In the axially extended leg of weir 17 is an overflow channel 20 with a mouth that empties into the vicinity of the specifically heavier liquid phase in subsequent compartment 19. Channel 20 diverts the specifically lighter liquid phase that gets separated in initial compartment 18.

An access line 21, which empties into a compartment 22 inside hub 11 supplies the lighter phase. Several access channels 23 lead from compartment 22 and empty into the vicinity of the heavier phase and of the inner surface of jacket 2 in initial mixing-and-separation compartment 18. Access line 21 is surrounded by another access line 24 that supplies the heavier phase, empties into a compartment 25 inside hub 11 but at a distance from compartment 22, and has one or more outlet openings 26 that empty into the vicinity of subsequent mixing-and-separation compartment 19.

The lighter phase is diverted over a skimmer 27 in a skimming compartment 28 inside housing cover 8. Skimming compartment 28 is separated from clarified-liquid zone 15 by overflow weir 29. The heavier phase, on the other hand, is diverted from clarified-liquid zone 14 in drum 1 through overflow tubes 30, which empty into an annular channel 31. The liquid is conducted from channel 31 through an outflow channel 32 out of drum 2 and into housing cover 8. The heavier phase is then conducted farther through discharge 33.

The threads 4 on the conveyer worm 3 in the conical section of drum 1 convey the solids centrifuged off in the drum to a takeout opening 34 in jacket 2, and they are removed through another takeout opening in housing case 7.

Figure 2:
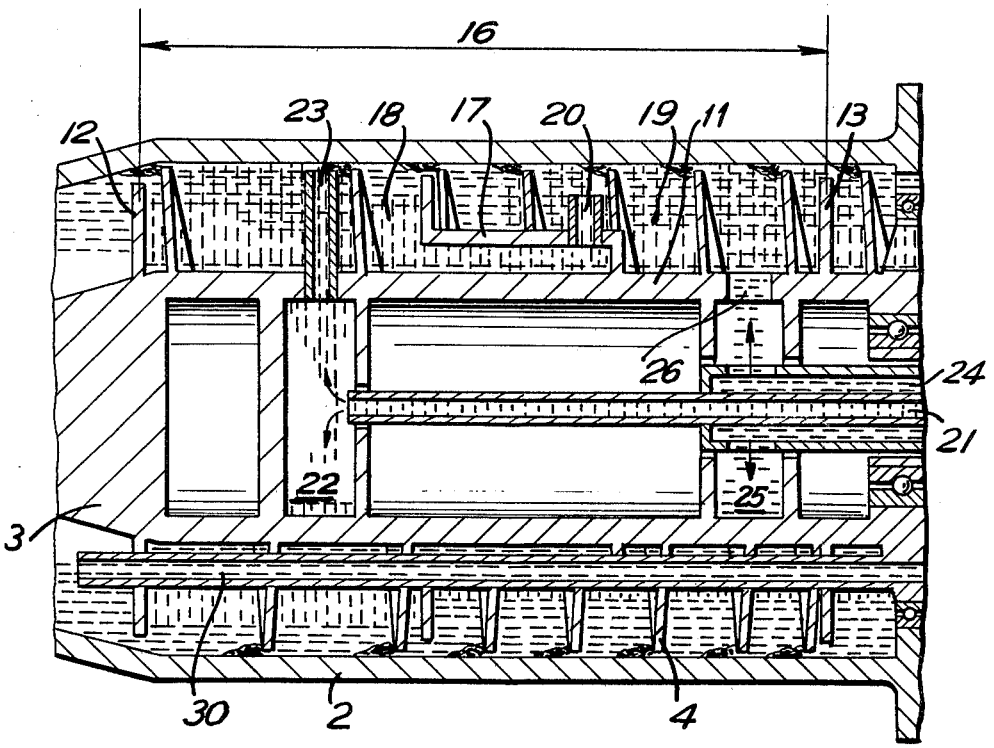

FIG. 2 is essentially an enlarged detail of the mixing zone 16 in FIG. 1 to illustrate the behavior of the liquids and solids inside the drum and the operation of the extractor will now be specified with respect to FIGS. 1 and 2.

Once the speed of drum 1 has been increased to operating level, the specifically heavier liquid phase, which contains the solids, is fed into compartment 25 inside hub 11 through access line 24. The liquid then travlels through outlet openings 26 into the vicinity of mixing zone 16. As soon as drum 1 has been charged with a predetermined amount of the heavier phase, the liquid will flow toward the conical section of the drum and will leave the rotation drum without being subjected to pressure through overflow tubes 30, annular channel 31, and outflow channel 32. The solids centrifuged off in the drum and settling on the inner surface of jacket 2 will simultaneously be picked up by the threads 4 of conveyer worm 3 and conveyed to takeout opening 34 in jacket 2, through which they are removed relatively dry.

Once drum 1 has been charged with the heavier phase, the specifically lighter liquid phase, the extractant, is fed into the drum through access line 21 in a countercurrent to the heavier phase. The lighter phase arrives first in compartment 22 inside hub 11. It then travels through access channels 23 and, subject to the pressure head generated in compartment 22, into the vicinity of the heavier phase in mixing-and-separating compartment 18 within mixing zone 16 between the threads 4 of conveyer worm 3. Since the lighter phase as a whole is now flowing through the heavier phase and since additional turbulence occurs in the liquids between rotating worm 3 and jacket 2, which are running at different speeds, the liquids get very thoroughly mixed in initial mixing-and-separation compartment 18.

The liquids will also now separate in the countercurrent between threads 4 to an extent that depends on the difference in the specific gravities of the two liquids and on the time they remain inside the drum. The at least to some extent separated lighter phase in compartment 18 can now be utilized for a further profound mixture with the heavier phase. The lighter phase is therefore conducted over the overflow weir 17 that separates mixing-and-separation compartments 18 and 19 and through overflow channel 20 into the heavier phase in subsequent mixing-and-separation compartment 19. The two liquids are again thoroughly mixed. Traveling toward the takeout point into clarified-liquid zone 15, the lighter phase flows in a countercurrent to the heavier phase that is flowing in from outlet openings 26. The two liquids are accordingly thoroughly mixed for the third time at this point. The lighter phase now travels on through clarified-liquid zone 15 into skimming compartment 28, from which it is expelled from drum 1 under pressure by skimmer 27.

The theory of the invention can also of course be applied to completely jacketed countercurrent centrifugal extractors in which the spent specifically heavier liquid phase is removed from the drum along with the solids.

It will be appreciated that the instant specification and claims are set forth by way of illustration and not limitation, and that various modifications and changes may be made without departing from the spirit and scope of the present invention.

What is claimed is:

1. In a continuous, completely jacketed countercurrent centrifugal extractor for mixing and separating two liquids of different specific gravities received through separate inlets, the extractor having a partially conical drum rotatable about a horizontal axis and including clarified-liquid zones and a mixing zone, with liquids flowing into the mixing zone from compartments inside the drum, a conveyer worm inside the drum rotatable at a speed different from that of the drum jacket and including threads that conform to the inner surface of the jacket and convey solids that settle under centrifugal force in a separation space between the hub of the worm and the drum into a conically contracting end of the drum, a skimmer inside a skimming compartment for carrying off an initial liquid phase and, a discharge space for another liquid phase that is separated from the separation space by an overflow weir and sealed off from the skimming compartment, the improvement comprising: at least one overflow weir in the mixing zone between the inlet for the lighter liquid phase and the inlet for the heavier liquid phase, means dividing the mixing zone into a series of mixing-and-separation compartments, means forming access channels emptying into the vicinity of the inner surface of the drum jacket and into that of the heavier phase to conduct the lighter phase out of the compartment inside the hub of the conveyor worm into the initial mixing-and-separation compartment, and means forming at least one overflow channel emptying into the vicinity of the heavier phase in the overflow weir to divert the lighter phase separated in the initial mixing-and-separation compartment into a subsequent mixing-and-separating compartment.

2. The extractor according to claim 1, wherein the mixing zone is between the threads of the conveyor worm.

3. The extractor according to claim 2, further comprising separating disks separating the clarified-liquid zones from the mixing zone.

4. The extractor according to claim 1, wherein the overflow weir has an annular gap facing the inner surface of the jacket and which is sealed off from the hub.

5. The extractor according to claim 4, wherein the overflow weir is angular in shape.

6. The extractor according to claim 5, wherein the overflow channel is formed in the axially extended leg of the overflow weir.

* * * * *